US006698530B2

(12) United States Patent
Hecht

(10) Patent No.: US 6,698,530 B2
(45) Date of Patent: Mar. 2, 2004

(54) MANUAL MACHINE TOOL

(75) Inventor: Joachim Hecht, Magstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/182,414

(22) PCT Filed: Nov. 22, 2001

(86) PCT No.: PCT/DE01/04409

§ 371 (c)(1),
(2), (4) Date: Jul. 29, 2002

(87) PCT Pub. No.: WO02/43928

PCT Pub. Date: Jun. 6, 2002

(65) Prior Publication Data

US 2003/0010511 A1 Jan. 16, 2003

(30) Foreign Application Priority Data

Nov. 30, 2000 (DE) ..... 100 59 388

(51) Int. Cl.[7] ..... B25D 11/06
(52) U.S. Cl. ..... 173/48; 173/104; 173/110; 173/109
(58) Field of Search ..... 173/48, 104, 109, 173/110, 111, 114, 205

(56) References Cited

U.S. PATENT DOCUMENTS

| | | | | |
|---|---|---|---|---|
| 1,755,565 A | * | 4/1930 | Shook | 74/56 |
| 2,850,739 A | | 9/1958 | Turner | |
| 2,970,483 A | * | 2/1961 | Schrum, Sr. | 74/22 R |
| 5,427,188 A | | 6/1995 | Fisher | |
| 5,449,044 A | * | 9/1995 | Phillips | 173/203 |
| 5,513,709 A | * | 5/1996 | Fisher | 173/205 |
| 6,199,640 B1 | * | 3/2001 | Hecht | 173/48 |

FOREIGN PATENT DOCUMENTS

| | | |
|---|---|---|
| DE | 810 140 C | 8/1951 |
| DE | 197 26 383 A1 | 12/1998 |

* cited by examiner

*Primary Examiner*—Scott A. Smith
*Assistant Examiner*—Chukwurah Nathaniel
(74) *Attorney, Agent, or Firm*—Michael J. Striker

(57) ABSTRACT

The invention is based on a hand power tool, in particular a hammer drill, with a drivable drive mechanism (12) accommodated in a housing (10) and a mechanical hammer unit (14), which is for percussion-driving a tool (16) in a tool holding fixture (18) and has a hammer (20) that can be driven in its hammering motion by a driver unit (22), which has at least one annular curved path (24, 26) with raised areas and recessed areas oriented axially toward the tool and has a feeler unit (28), which is operationally connected to the hammer (20) and which, by at least one feeler element (30), can be brought into operational connection with the raised areas and recessed areas of the curved path (24, 26).

The invention proposes that the feeler unit (28) has at least two feeler elements (30) that can be brought into operational connection with the curved path (24, 26).

10 Claims, 4 Drawing Sheets

MANUAL MACHINE TOOL

BACKGROUND OF THE INVENTION

The invention is based on hand power tool.

DE 197 26 383 A1 has disclosed a hand power tool that defines the species, specifically an electrically driven hammer drill. The hammer drill has a rotary driven working spindle that is supported in a housing and in turn drives a tool holding fixture of a tool. The hammer drill also has a mechanical hammer unit with a hammer, which can move axially inside the working spindle embodied as a hollow shaft and can be accelerated in the axial direction, and which acts directly or indirectly on a shaft of the tool during operation. The hammer is acted on by a driver unit, which converts a rotary motion of the working spindle into an axial acceleration of the hammer.

The driver unit has a feeler unit that can move axially and rotates synchronously with the working spindle and that is guided with axial play between two annular curved paths, which do not rotate in relation to the working spindle and have raised areas and recessed areas oriented toward each other in the axial direction of the working spindle. The feeler unit is constituted by an annular component, which can be moved on the hammer in the axial direction, counter to a compression spring and which has a feeler element extending radially outward, which reaches through a slot in the working spindle between the curved paths and can thus bring the feeler unit into an operative connection with the curved paths.

For a switching on and off of the hammer unit, the curved path oriented toward the tool is supported so that it can move axially in tandem with the working spindle. If the tool is pressed against a working surface, the working spindle at the curved path oriented toward the tool is slid axially toward the curved path oriented away from the tool, counter to an idling spring embodied as a compression spring so that the feeler element comes into contact with the two curved paths during a rotating motion. The hammer unit is switched on.

If the tool is lifted up from the working surface, the curved path oriented toward tool and the working spindle are restored to their initial position by the idling spring. The distance between the two curved paths is thereby enlarged to such an extent that the feeler element in rotate freely between the two curved paths, without coming into contact with them. The hammer unit is switched off.

SUMMARY OF THE INVENTION

The invention is based on a hand power tool, in particular a hammer drill, with a drivable drive mechanism accommodated in a housing and a mechanical hammer unit, which is for percussion-driving a tool in a tool holding fixture and has a hammer that can be driven in its hammering motion by means of a driver unit, which has at least one curved path with raised areas and recessed areas oriented axially toward the tool and has a feeler unit, which is operationally connected to the hammer and which, by means of at least one feeler element, can be brought into operational connection with the raised areas and recessed areas of the curved path.

The invention proposes that the feeler unit has at least two and preferably three or more feeler elements that can be brought into operational connection with the curved path. A tilting moment on the feeler unit and the hammer can be prevented and a centering of the feeler unit on the curved path can be achieved. The efficiency can be increased and the wear can the reduced.

If the feeler elements have at least one sloped surface at least partly oriented in the rotation direction and/or counter to the rotation direction, the feeler elements can be advantageously guided with a minimum of wear from a recessed area of a curved path onto a raised area of the curved bath and from a raised area of the curved path into a recessed area of the curved path. A tilting contact between the feeler elements and the curved paths can be prevented. The sloped surfaces can, for example, be constituted by a concavely curving sloped surface or by a phase.

In order to assure a reliable engagement and disengagement of the hammer unit and to assure a reliable neutral position, when in this neutral position, a respective stop limits the movement of the feeler elements of the feeler unit in the axial direction toward at least one curved path, or when there are two curved paths, advantageously limits this movement of the feeler elements in the axial direction toward both functional curved paths. If the drive mechanism is supported in an axially mobile fashion, and if a stop is constituted by a device affixed to the drive mechanism, for example a securing ring, a shoulder formed onto the drive mechanism, or the like, then a disengaging movement of the drive mechanism can be advantageously used to correspondingly position a stop in order to limit the movement of the feeler elements of the feeler unit.

Another embodiment of the invention proposes that a stop is constituted by a component, which, when the hammer unit is in a hammering position, forms a part of curved path, which permits an embodiment that is particularly compact and lightweight to be produced. This can be achieved in a structurally simple manner particularly in that the component is comprised of a ring with openings, which extend in the circumference direction and are separated by struts, and in the hammering position, partial regions of the curved paths protrude through the openings, the struts plunge into recesses between the partial regions, and form a part of the curved path.

Instead of two curved paths between which the feeler unit is disposed, the driver unit can also be embodied with only one curved path, one whose raised areas and recessed areas are oriented axially toward the tool. The device must be balanced in such a way that the feeler unit is moved back toward the curved path by a spring and/or by the hammer rebounding off a stop surface. This permits additional components, space, and weight to be saved in comparison to a driver unit with two curved paths.

BRIEF DESCRIPTION OF THE DRAWINGS

Further advantages ensue from the following description of the drawings. The drawings show an exemplary embodiment of the invention. The drawings, the specification, and the claims contain numerous features in combination. One skilled in the art will also suitably consider the features individually and unite them in other meaningful combinations.

DESCRIPTION OF THE PREFERRED EMBODIMENT

Figure 1:
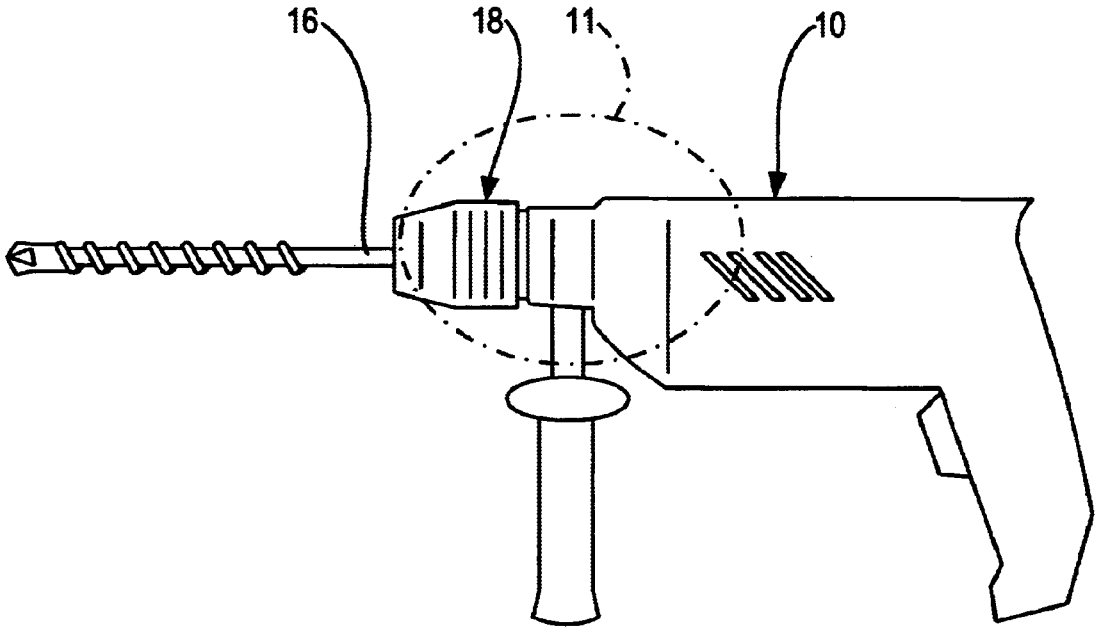
FIG. 1 shows a side view of a hammer drill.

FIG. 1 shows a hammer drill in a side view, with a drive mechanism 12 (FIGS. 2 and 3) embodied as a spindle, which can be driven to rotate in a housing 10 by an electric motor that is not shown in detail. The hammer drill has a mechanical hammer unit 14 for percussion-driving a drill bit 16, which is held in a tool holding fixture 18. The hammer unit 14 has a hammer 20, which can be driven in its hammering motion by a driver unit 22 and is movably supported in the drive mechanism 12, which is embodied as a hollow shaft. On an end oriented toward the tool holding fixture 18, the drive mechanism 12 is supported by a needle bearing 104 that encompasses the drive mechanism. At an end oriented away from the tool holding fixture 18, the drive mechanism 12 is supported by a ball bearing 108, which is disposed on a plastic bearing journal 106 that is formed onto the housing 10 and extends radially inside the drive mechanism 12, which permits space to be saved. Alternative slide bearings 104*a* and 108*a* are shown in the lower half; the slide bearing 108*a* remote from the tool holding fixture 18 is disposed on a separate metal bearing journal 106*a* that is press-fitted into the housing 10.

The driver unit 22 has two annular curved paths 24, 26 non-rotatably situated in the housing 10, which each have five sinusoidal recessed areas and raised areas oriented toward each other in the axial direction of the drive mechanism 12. In principle, however, it is also conceivable for there to be a larger or smaller number of raised areas and recessed areas. Furthermore, curved paths can be used, which have different amplitudes and/or curve progressions, for example curves that also deviate from a sinusoidal form. In a hand power tool with a tool that is stationary in the rotation direction, curved paths with only one raised area and one recessed area would actually also be conceivable.

Figure 4:
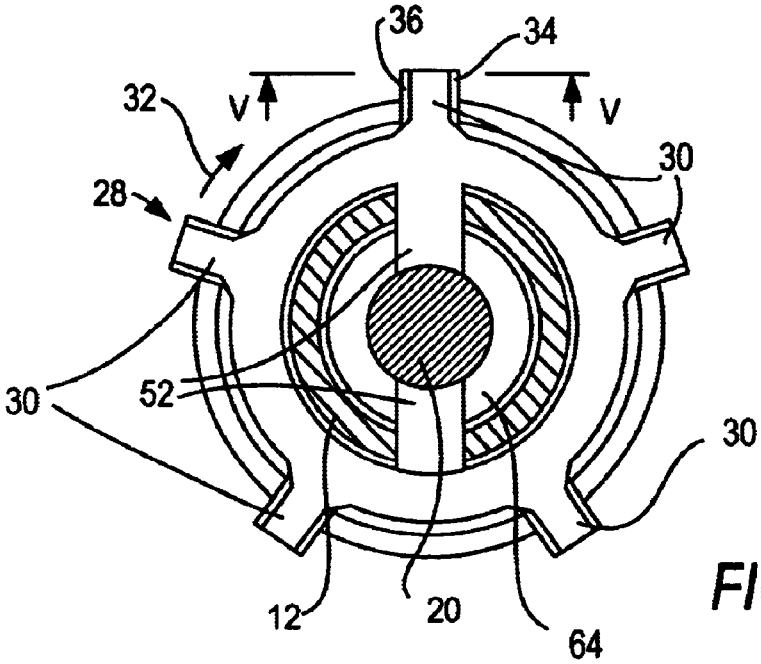
FIG. 4 shows a section along the line IV—IV in FIG. 3.
Figure 5:
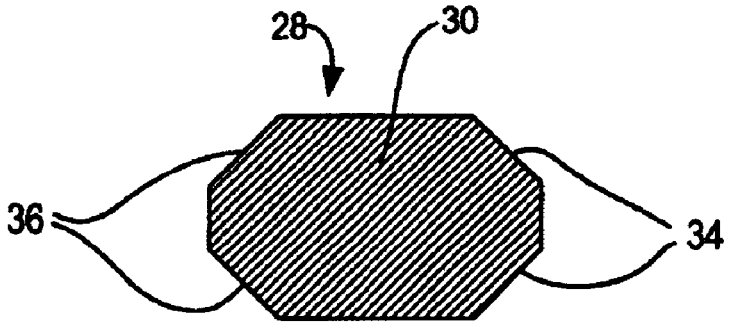
FIG. 5 shows a section along the line V—V in FIG. 4.

Between the curved paths 24, 26, there is a feeler unit 28, which can be driven to rotate. The feeler unit 28 is comprised of an annular component that has five strut-shaped feeler elements 30 extending radially outward and distributed evenly over the circumference and has two strut-shaped driver elements 52 extending radially inward (FIG. 4).

Figure 2:
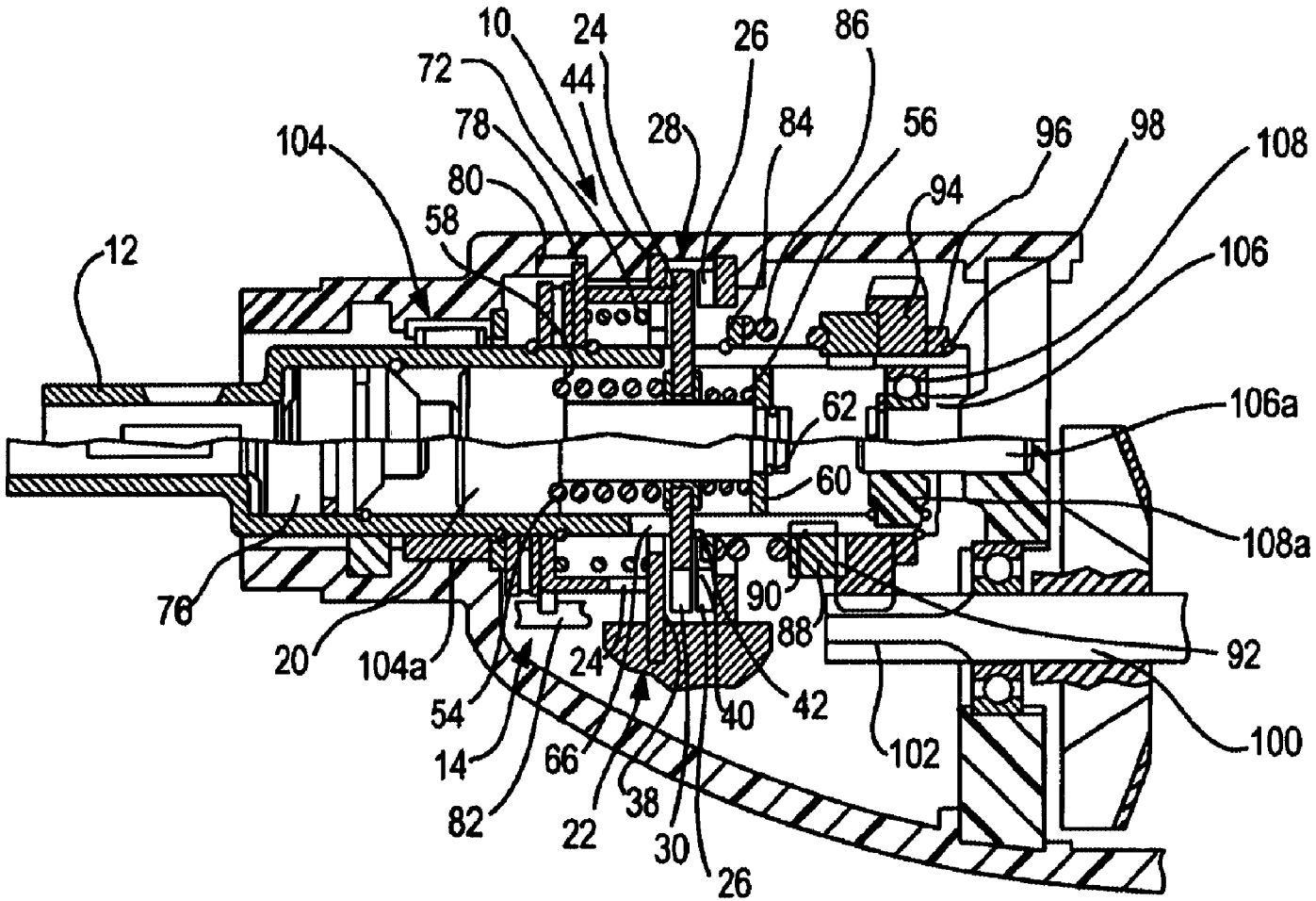
FIG. 2 shows a sectional view of an enlarged detail II from FIG. 1.
Figure 3:
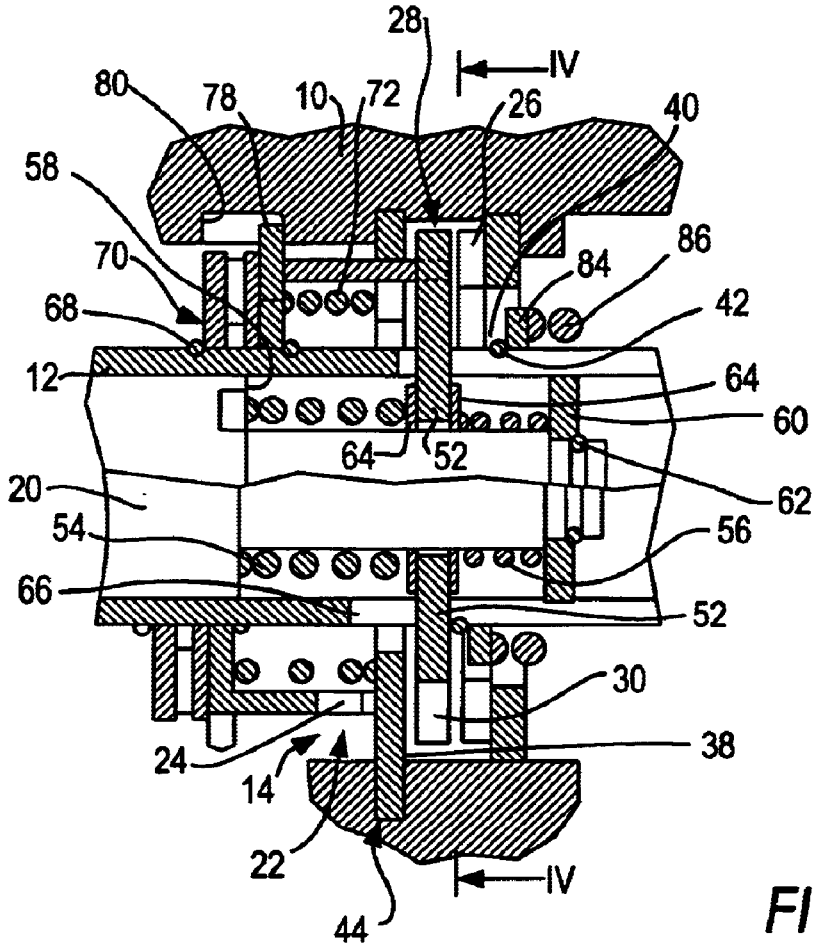
FIG. 3 shows a detail of a hammer unit from FIG. 2 during hammering operation.

The component comprising the feeler unit 28, with its driver elements 52 extending radially inward, reaches between two sliding rings 64 disposed on the hammer 20. The feeler unit 28 is supported so that it can rotate between the sliding rings 64 and so that it can be moved axially on the hammer 20 by the sliding rings 64, between two helical compression springs 54, 56 (FIGS. 2 and 3). In principle, a feeler unit and a hammer could also be non-rotatably connected to each other. The helical compression spring 54 closer to the tool holding fixture 18 is supported, in the direction oriented toward the tool holding fixture 18, against a stop 58 formed onto the hammer 20 and acts on the feeler unit 28 in the direction oriented away from the tool holding fixture 18 by means of a sliding ring 64. The helical compression spring 56 remote from the tool holding fixture 18 is supported, in the direction oriented away from the tool holding fixture 18, against the hammer 20 by means of a spring support 60 and by means of a securing ring 62 fastened to the hammer 20 and acts on the feeler unit 28 in the direction oriented toward the tool holding fixture 18 by means of a sliding ring 64. The helical compression springs 54, 56 are prestressed toward each other.

In addition, the feeler unit 28, with its feeler elements 30 extending radially outward, reaches through slot-shaped openings 66 extending axially in the drive mechanism 12 and is form-fittingly connected in the rotation direction 32 to the drive mechanism 12. By means of the feeler elements 30, the feeler unit 28 remains operationally connected to the curved paths 24, 26 during a hammering operation. In lieu of a feeler unit that can be driven to rotate, in principle, the curved paths could also be designed so that they could be driven to rotate.

In order to keep the wear between the feeler elements 30 and the curved paths 24, 26 as low as possible, the feeler elements 30 have sloped surfaces 34, 36, which are comprised of phases, oriented toward the two curved paths 24, 26, in the rotation direction 32 and counter to the rotation direction 32.

The drive mechanism 12 is supported so that can be moved in the axial direction along with the tool holding fixture 18. If the hammer drill is pressed with the drill bit 16 against a working surface, the drill bit 16, together with the tool holding fixture 18 and the drive mechanism 12, is slid into the housing 10, as shown in the upper half of FIG. 2 down to the center line of the drive mechanism 12. By means of a securing ring 68 and an axial bearing 70, the drive mechanism 12 acts in the axial direction on a cup-shaped sleeve (FIG. 3). The sleeve is fixed in the rotation direction in the housing 10 by means of cylindrical pins 82 and is supported so that it can slide in the axial direction (FIGS. 2 and 3).

The cup-shaped sleeve extends axially with its cup wall in the direction oriented away from the tool holding fixture 18, and a part of the front curved path 24 is formed onto an end of the cup wall oriented toward the feeler unit 28. A helical compression spring 72, which is disposed in the sleeve, radially encompasses the drive mechanism 12, and is supported, in the direction oriented away from the tool holding fixture 18, against an annular spring plate 44 affixed to the housing, acts on the bottom of the sleeve in the direction toward the tool holding fixture 18. By means of the drive mechanism 12, the sleeve and along with it, a part of the front curved path 24, is slid counter to the helical compression spring 72 until the sleeve strikes against the spring plate 44.

Figure 6:
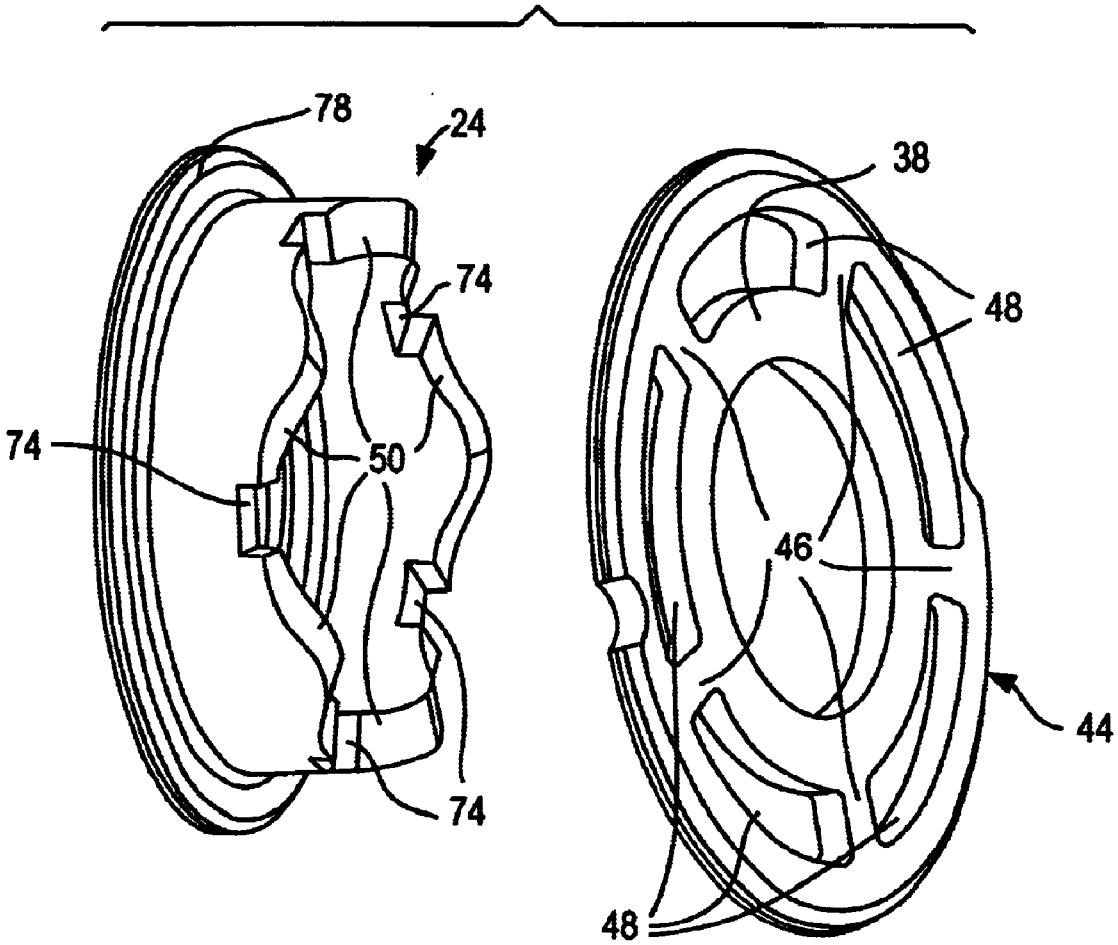
FIG. 6 shows a curved path with an annular component that constitutes a stop.

If the sleeve is slid into its end position oriented away from the tool holding fixture 18, partial regions 50 of the curved path 24 formed onto the end of the sleeve reach through circumferentially extending openings 48 of the spring plate 44 (FIG. 6). The openings 48 are separated by struts 46, and in the end position or hammering position, plunge into recesses 74 in the cup wall of the cup-shaped sleeve, between the partial regions 50, and form a part of the curved path 24.

In the hammering position, the rotary driven feeler unit 28 comes into contact with the curved paths 24, 26 by means of its feeler elements 30 and drives the hammer 20 in a translatory fashion by means of the helical compression springs 54, 56. The hammer 20 acts in a translatory fashion on a snap 76, which strikes against an end of the drill bit 16 oriented toward the housing 10. The hammer unit 14 is switched on. Depending on the design, the feeler unit 28 leaves the curved path 26, which is oriented away from the tool holding fixture 18, before or after a dead center of the tool. It is also possible for there to be a design in which the feeler unit 28 continuously travels on the curved path 26 in a steady state. In lieu of a stop on the drill bit 16, it would also be conceivable for a hammer or a snap to strike directly or indirectly against a drive mechanism, a tool holding fixture, or another component viewed as suitable by one skilled in the art.

If the drill bit 16 is lifted up from the working surface, then by means of the sleeve bottom, the helical compression spring 72 slides the cup-shaped sleeve with the partial regions 50 of the curved path 24, the drive mechanism 12, and the tool holding fixture 18 with the drill bit 16 into their initial position, until the cup-shaped sleeve, with a radially outward extending collar 78 formed onto it, comes into contact with a stop 80 in the housing 10.

The partial regions 50 of the curved path 24 thereby travel toward the tool holding fixture 18 through the openings 48 of the spring plate 44, whose axial end oriented toward the feeler unit 28 constitutes a stop 38, which, in the neutral position of the hammer unit 14, limits the axial movement of the feeler unit 28 and its feeler elements 30 in the direction of the curved path 24 or the functional curved path 24.

Along with the drive mechanism 12, a device 42, which is fastened to the drive mechanism 12 and is comprised of a securing ring, moves axially through the annular curved path 26, which is oriented away from the tool holding fixture 18 and is affixed in the housing 10 axially and radially, and constitutes a second stop 40, which limits the movement of the feeler unit 28 and its feeler elements 30 axially in the direction of the curved path 26 (FIG. 2). The stops 38, 40 reliably prevent a contact between the feeler elements 30 and the functional curved paths 24, 26 in the neutral position of the hammer unit 14.

In the direction of the tool holding fixture 18, the securing ring also supports a spring plate 84 for a locking spring 86, which acts on a locking disk 88 in the direction oriented away from the tool holding fixture 18 (FIG. 2). With driver elements 90 oriented radially inward, the locking disk 88 engages in a form-fitting manner in the rotation direction in recesses of the drive mechanism 12 and on the side oriented away from the tool holding fixture 18, has axially extending locking pins 92. The locking pins 92 engage in a form-fitting manner in the rotation direction in recesses of a gear 94 that is supported in rotary fashion on the drive mechanism 12 and meshes with a pinion 102 formed onto a driveshaft 100. In the direction oriented away from the tool holding fixture 18, the gear 94 is supported on the drive mechanism 12 by a stop ring 96 and a securing ring 98.

If an existing torque exceeds a particular value, the locking ring 18 can move out of the way in the axial direction toward the tool holding fixture 18, counter to the locking spring 86, the locking pins 92 can slide in the rotation direction over the recesses in the gear 94, and a rotary drive of the drive mechanism 12 can be interrupted.

| Reference Numerals | |
|---|---|
| 10 | housing |
| 12 | drive mechanism |
| 14 | hammer unit |
| 16 | tool |
| 18 | tool holding fixture |
| 20 | hammer |
| 22 | driver unit |
| 24 | curved path |
| 26 | curved path |
| 28 | feeler unit |
| 30 | feeler element |
| 32 | rotation direction |
| 34 | sloped surface |
| 36 | sloped surface |
| 38 | stop |
| 40 | stop |
| 42 | device |
| 44 | component |
| 46 | strut |
| 48 | opening |
| 50 | partial regions |
| 52 | driver element |

-continued

| Reference Numerals | |
|---|---|
| 54 | helical compression spring |
| 56 | helical compression spring |
| 58 | shoulder |
| 60 | spring support |
| 62 | securing ring |
| 64 | sliding ring |
| 66 | opening |
| 68 | securing ring |
| 70 | axial bearing |
| 72 | helical compression spring |
| 74 | recess |
| 76 | snap |
| 78 | collar |
| 80 | stop |
| 82 | cylindrical pin |
| 84 | spring plate |
| 86 | locking spring |
| 88 | locking disk |
| 90 | driver element |
| 92 | locking pin |
| 94 | gear |
| 96 | stop ring |
| 98 | securing ring |
| 100 | driveshaft |
| 102 | pinion |
| 104 | needle bearing |
| 106 | bearing journal |
| 108 | ball bearing |

What is claimed is:

1. A hand power tool, in particular a hammer drill, with a drivable drive mechanism (12) accommodated in a housing (10) and a mechanical hammer unit (14), which is for percussion-driving a tool (16) in a tool holding fixture (18) and has a hammer (20) that is drivable in its hammering motion by means of a driver unit (22), which has at least one curved path (24, 26) with raised areas and recessed areas oriented axially toward the tool and has a feeler unit (28), which is operationally connected to the hammer (20) and which, by means of at least one feeler element (30), is bringable into operational connection with the raised areas and recessed areas of the curved path (24, 26), characterized in that the feeler unit (28) has at least two feeler elements (30) that are spaced from one another and bringable into operational connection with the curved path (24, 26).

2. The hand power tool according to claim 1, characterized in that the feeler elements (30) have at least one sloped surface (34) at least partly oriented in the rotation direction (32).

3. The hand power tool according to claim 1, characterized in that the feeler elements (30) have at least one sloped surface (34) at least partly oriented counter to the rotation direction (32).

4. The hand power tool according to claim 1 in that in a neutral position, a stop (8, 40) limits the movement of the feeler elements (30) of the feeler unit (28) in the axial direction toward at least one functional curved path (24, 26).

5. The hand power tool according to claim 4, characterized in that the drive mechanism (12) is supported so that it can move axially and a stop (40) is constituted by a device (42) affixed to the drive mechanism (12).

6. The hand power tool according to claim 5, characterized in that the device (42) is constituted by a securing ring fastened to the drive mechanism (12).

7. The hand power tool according to claim 4, characterized in that a stop (38) is constituted by a component (44), which forms a part of a curved path (24) in a hammering position of the hammer unit (14).

8. The hand power tool according to claim 7, characterized in that the component (44) is constituted by a ring with openings (48), which extend in the circumference direction and are separated by struts (46), and in the hammering position, partial regions (50) of the curved path (24) protrude through the openings (48), the struts (46) plunge into recesses (74) between the partial regions (50), and form a part of the curved path (24).

9. The hand power tool according to one of claim 1, characterized in that the driver unit has only one curved path.

10. A hand power tool, in particular a hammer drill, with a drivable drive mechanism (12) accommodated in a housing (10) and a mechanical hammer unit (14), which is for percussion-driving a tool (16) in a tool holding fixture (18) and has a hammer (20) that is drivable in its hammering motion by means of a driver unit (22), which has at least one curved path (24, 26) with raised areas and recessed areas oriented axially toward the tool and has a feeler unit (28), which is operationally connected to the hammer (20) and which, by means of at least one feeler element (30), is bringable into operational connection with the raised areas and recessed areas of the curved path (24, 26), characterized in that the filler unit (28) has at least two feeler elements that are spaced from one another and that are distributed evenly over a circumference in the rotation direction (32) and are bringable in operational connection with the curved path (24, 26).

* * * * *